US007594950B2

(12) United States Patent
Oka et al.

(10) Patent No.: US 7,594,950 B2
(45) Date of Patent: Sep. 29, 2009

(54) METHOD AND DEVICE FOR REMOVING SLAG

(75) Inventors: Hiroaki Oka, Yokohama (JP); Nariaki Oka, Yokohama (JP)

(73) Assignee: Sanki Dengyo Co., Ltd., Kanagawa (JP)

( * ) Notice: Subject to any disclaimer, the term of this patent is extended or adjusted under 35 U.S.C. 154(b) by 343 days.

(21) Appl. No.: 11/490,253

(22) Filed: Jul. 21, 2006

(65) Prior Publication Data

US 2007/0017320 A1 Jan. 25, 2007

(30) Foreign Application Priority Data

Jul. 22, 2005 (JP) ..... 2005-212916

(51) Int. Cl.
*C22B 9/02* (2006.01)

(52) U.S. Cl. ..... 75/407; 266/228

(58) Field of Classification Search ..... 75/407; 266/228

See application file for complete search history.

(56) References Cited

U.S. PATENT DOCUMENTS 502,122 A * 7/1893 Howard ..... 75/407
4,526,352 A 7/1985 Roper
2006/0091070 A1 5/2006 Aufderheide et al.

FOREIGN PATENT DOCUMENTS

JP 5-240588 9/1993
JP 05302157 A * 11/1993
JP 6-3068 1/1994
JP 11-12662 1/1999
JP 2004-130330 4/2004

OTHER PUBLICATIONS

Written Translation of JP 53-15204A, published Feb. 10, 1978.*
Machine translation of JP 05-302157, published Nov. 1993.*
Paul Day et al.; Filtration of Irons with Cellular Ceramic Filters; Modern Casting, pp. 16-18; Apr. 1984.
A. L. Matthews; Ceramic Filters for the Cast Metal Industry; Key Engineering Materials, vols. 122-124, pp. 293-303; 1996.
Fuwang Chen et al.; Investigation on foam ceramic filter to remove inclusions in revert superalloy; Material Letters 34, pp. 372-376; Mar. 1998.
European Search Report dated Dec. 29, 2006 of EP 06 01 5313.7-2122.

* cited by examiner

*Primary Examiner*—George Wyszomierski
*Assistant Examiner*—Tima M McGuthry-Banks
(74) *Attorney, Agent, or Firm*—Westerman, Hattori, Daniels & Adrian, LLP.

(57) ABSTRACT

A method for removing slag comprises: preparing a filter 21 of heat-resistant porous ceramics, which passes a molten metal and catches slag, liquidizing metal material to form a molten metal A on which slag is floating; and traveling filter 21 along a surface of the molten metal A and removing slag. And a device for removing slag comprises: a filter 21 of heat-resistant porous ceramics, which passes a molten metal and catches slag; and a driving device for traveling filter 21 along a surface of the molten metal on which slag is floating and removing slag.

5 Claims, 4 Drawing Sheets

METHOD AND DEVICE FOR REMOVING SLAG

BACKGROUND OF THE INVENTION

1. Field of the Invention

The present invention relates to a method and a device for removing slag, which is generated on a surface of molten metal in a metal furnace.

2. Description of the Related Art

When a metal material is liquidized in a liquidizing furnace by heating in a vacuum atmosphere so as to form a molten metal and cast into a mold for precise casing, slag is generated on a surface of the molten metal. Since it is difficult to remove the slag, the molten metal is cast in the mold with the slag, the slag affects the quality of the produced cast products. Particularly in producing precise cast products (for example, parts for air and space industry), any slag is not allowed to be contained. Thus, any contaminant of the slag significantly affects the yield of the cast products particularly in the precise cast products field.

Heretofore, when the molten metal is cast into the mold, slag is conventionally prevented from entering into the mold by the following methods: One method is to remove the slag by tilting the furnace to the other side of the mold for removing the slag before pouring the molten metal into the mold. Another method is to remove the slag by installing a filter at an entrance of the mold for filtering the slag.

However, even though the slag can be removed by tilting the furnace to the other side of the mold before pouring the hot melt into the mold, it is difficult to remove the slag perfectly. By installing a filter at entrance of the mold for filtering the slag, it is easy to remove a larger size of the slag, but it is difficult to remove a smaller size of the slag. If trying to remove the smaller size of the slag by the filter, it is required to make the filter finer, however when making the filter finer, it causes slower of flowing speed of the molten metal into the mold and generates bad products because of lack of the molten metal flowing into the mold. Further, the filter chips easily, and when chip of the filter is entered into the mold with hot melt, it generates bad products because of contaminants of filter chip.

Further, a method of removing slag, which is floating on a surface of the molten metal, in air atmosphere is known as Japanese laid-open patent publication No. H5-240588.

SUMMARY OF THE INVENTION

It is therefore an object of the present invention to provide a method and a device for removing slag, which is capable of removing slag efficiently in a liquidizing furnace for precise-casting, in which any contaminant of slag is not allowed.

To achieve the above object, there is provided in accordance with the present invention, a method and a device for removing slag comprises traveling a filter of heat-resistant porous ceramics along a surface of the molten metal and removing the slag, which is generated by liquidizing metal material by heating and floating on the surface of the molten metal in the furnace.

According to the present invention, since the filter passes the molten metal and catches slag only, therefore, by traveling the filter along a surface of the molten metal, on which slag is floating, the filter can catch slag and remove slag from the molten metal effectively. Thus, by pouring the molten metal without any contaminants of slag into a mold directly, precise cast products can be produced with high yield.

The above and other objects, features, and advantages of the present invention will become apparent from the following description when taken in conjunction with the accompanying drawings, which illustrate a preferred embodiment of the present invention by way of example.

DETAILS DESCRIPTION OF THE PREFERRED EMBODIMENTS

Figure 1:
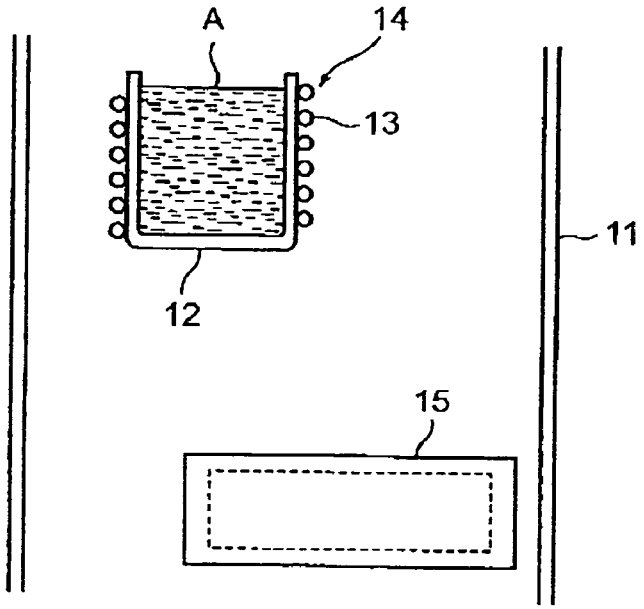
FIG. 1 is a view of essential portion of a vacuum liquidizing and casting apparatus and relating to a step of liquidizing metal and removing slag.

Preferred embodiments will be described with referring to the attached drawings. Like or corresponding parts are denoted by the same reference characters throughout views, and will not repetitively be described.

FIG. 1 shows an essential portion of a vacuum liquidizing and casting apparatus. The vacuum liquidizing and casting apparatus 11 is provided with a furnace 14 for liquidizing metal such as iron/nickel alloy by heating and mold 15 for casting precise cast products by pouring molten metal generated by the furnace 14. The furnace 14 is provided with crucible 12 and coil 13 for liquidizing metal material loaded in crucible 12 by induction heating. Inside of vacuum liquidizing and casting apparatus 11 is evacuated to vacuum atmosphere. Metal material is loaded into crucible 12 from loading gate (not shown) and heated up to liquidizing temperature by induction heating of applying high frequency current to coil 13, and then liquidized to be a molten metal A. Since the molten metal A is formed in vacuum atmosphere, oxidation of the molten metal A is relatively less, and contamination of the molten metal A is quite less, and then pure molten metal A is formed. However, slag is generated in process of liquidizing the metal material by reactions of the molten metal A and crucible 12, and so on.

Figure 2:
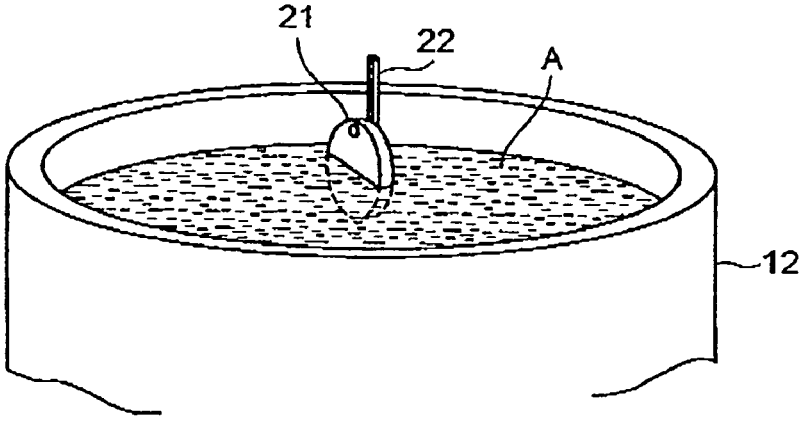
FIG. 2 is a perspective view showing a step of traveling a filter along a surface of molten metal and removing the slag according to an embodiment of the present invention.

When temperature of the molten metal A reaches to a predetermined temperature, induction heating is stopped and molten metal A becomes settled down to be a quiet state. Then, since the specific gravity of the slag is lower, the slag becomes floating on the surface of the molten metal A. As shown in FIG. 2, by traveling the filter 21 for filtering slag along the surface of molten metal A, filter 21 catch slag floating on the surface of molten metal A, and then slag is removed from the molten metal A. Since filter 21 for filtering slag passes the molten metal and catches the slag only, filter 21 effectively catches and removes slag floating on the surface of molten metal A.

Figure 3:
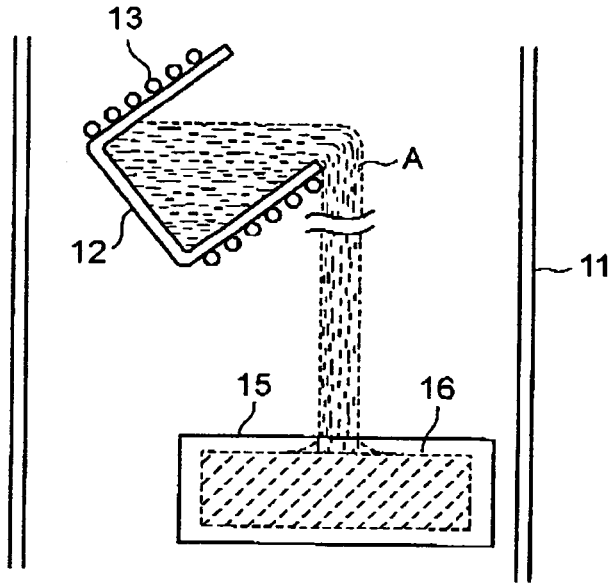
FIG. 3 is a view of essential portion of a vacuum liquidizing and casting apparatus and relating to a step of pouring the molten metal into a mold for casing.

Molten metal A, from which slag has been removed, is poured directly (without passing through filter) to mold 15 as shown in FIG. 3 and cast product 16 is produced. Since filter is not provided at entrance of mold 15 for filtering slag, molten metal A flows fast inside of mold 15 and fluidity of hot melt A in mold 15 is excellent. For example, very thin blade for air and space industry parts can be cast with excellent precise-formability. Further, since filter is not provided at entrance of mold 15 for filtering slag, a problem that the filter at the entrance of the mold easily chips and the fragment of the filter enters into the mold 15 with the molten metal A never happens. Therefore, since the molten metal A without slag can be poured directly to mold 15, excellent fluidity of the molten metal A in mold 15 can be obtained and precise cast products such as a thin blade for air and space industry parts can be produced at high production yield.

Figure 4A:
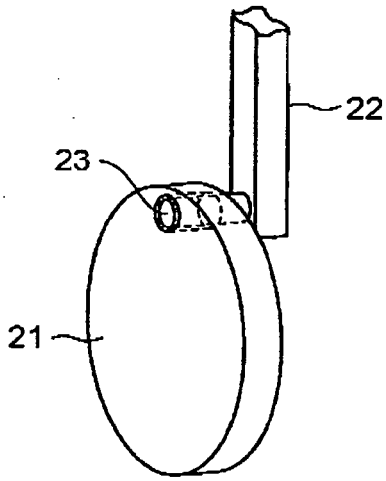
FIGS. 4A and 4B is a perspective view of examples of filters of the present invention.
Figure 4B:
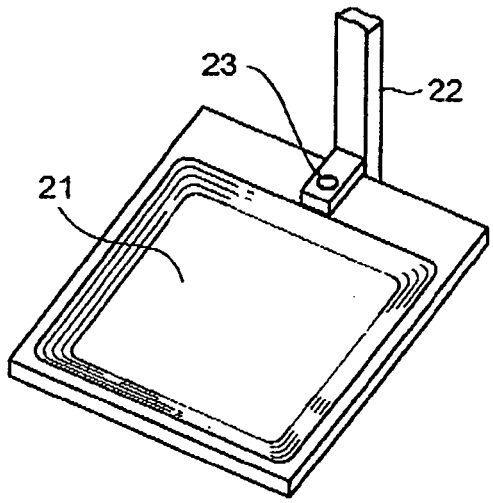

FIGS. 4A and 4B show examples of filter structures of the present invention. Material of filter 21 comprises highly heat-resistant porous ceramics and has been used for the filter, which is installed at entrance of the mold for removing slag as stated in "BACKGROUND OF THE INVENTION". FIG. 4A shows an example of disk-shaped filter and FIG. 4B shows an example of plate-shaped filter having concave portion, which can catch the slag easily. These filters 21 travel along the surface of the molten metal A such that its lower half portion of filter 21 is immersed in the molten metal A and its upper half portion of filter 21 is shown above the surface of the molten metal A. Filter 21 is provided with an arm 22, and arm 22 is fixed to filter 21 by fixing element 23 such as pin. Arm 22 drives filter 21 to travel along the surface of molten metal A. Further, the shape and filtering performance of filter 21 should be determined in correspondence with kinds of the molten metal and so on.

Figure 5:
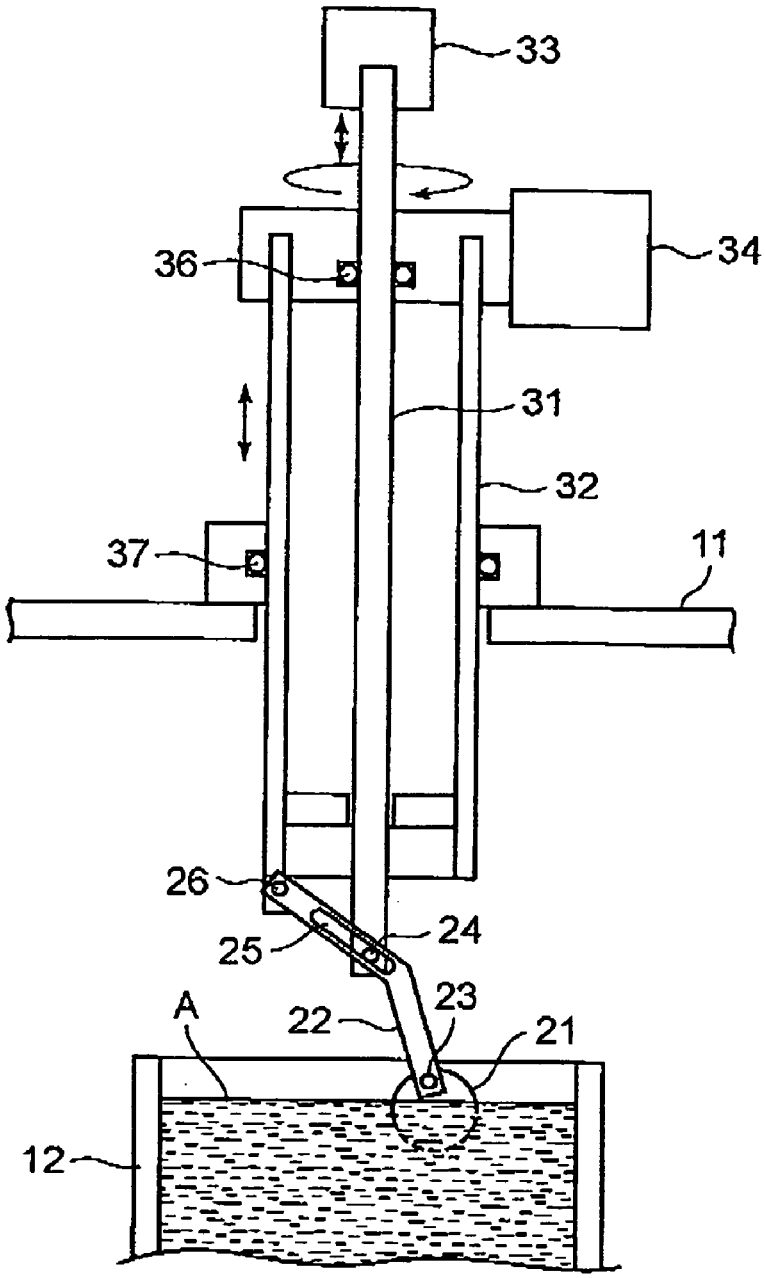
FIG. 5 is a view of an example of a driving device for traveling the filter of the present invention.

FIG. 5 shows an example of a device for traveling filter 21 and removing slag on the surface of the molten metal A. The device comprises: a rod 31 disposed above central, portion of crucible 12, which accommodates the molten metal A; an outer cylinder 32 coaxially disposed with rod 31, wherein cylinder 32 is rotatable and vertically movable with rod 31, and also rod 31 is vertically movable relatively against cylinder 32; a driving device 33 for moving rod 31 vertically relatively against cylinder 32; and a driving device 34 for moving and rotating rod 31 and cylinder 32 as one unit. O-ring 36 seals rod 31 and cylinder 32 is sealed by O-ring 37, and then vacuum atmosphere can be maintained in vacuum liquidizing and casting apparatus 11.

One end of arm 22 is rotatably fixed to the lower end of cylinder 32. Arm 22 is provided with a long-width hole 26, and a pin 24 disposed at the lower end of rod 31 is engaged to long-width hole 26 and then arm 22 is slidably fixed to rod 31. Another end of arm 22 is fixed to filter 21 by fixing element 23. Therefore, by moving rod 31 vertically relatively against cylinder 32, arm 22 can be rotated around pin 26 and radial position of filter 21 in crucible 12 is determined. Moving rod 31 and cylinder 32 vertically as one unit, vertical position of filter 21 in crucible 12 is determined. Rotating rod 31 and cylinder 32 around rod 31 as one unit, filter 21 travels rotating (in circumference direction) around rod 31 on the surface of hot melt A in crucible 12.

Figure 6A:
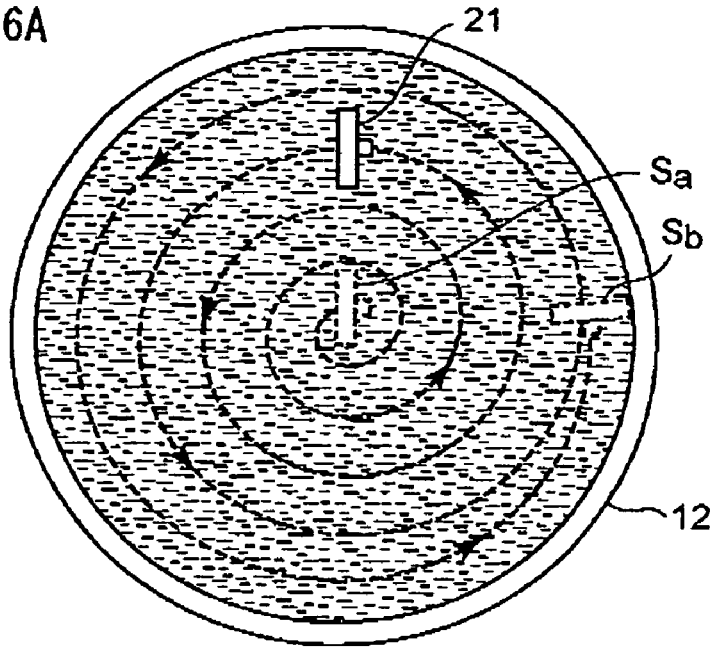
FIGS. 6A and 6B is a plan view of examples of traveling paths of filters in a crucible of the present invention
Figure 6B:
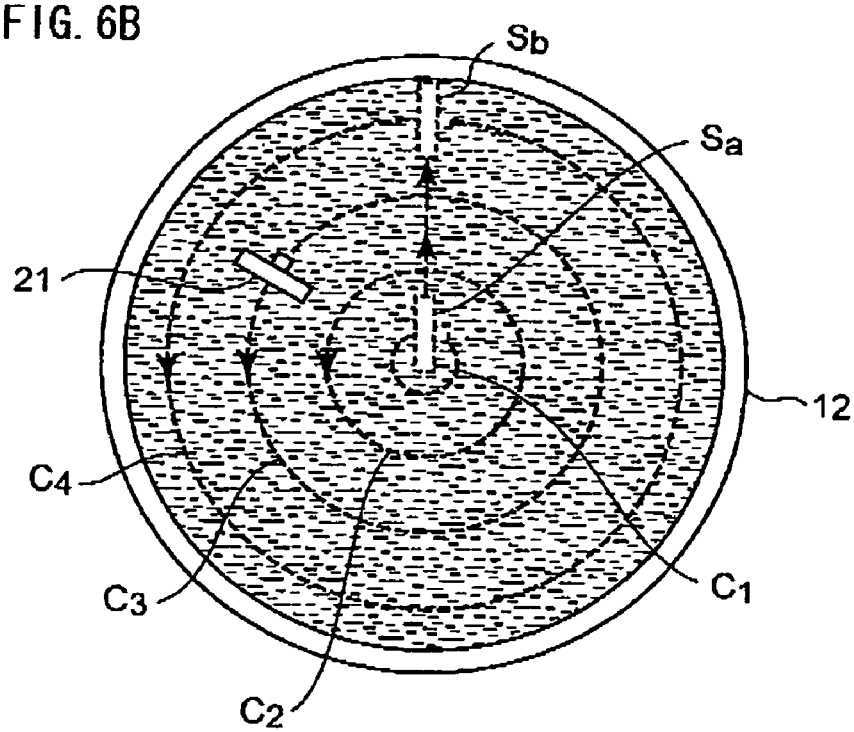

FIGS. 6A and 6B show examples of traveling paths of the filters for removing the slag floating on a surface of the molten metal in a crucible. FIG. 6A shows that filter 21 travels spirally in crucible 12 from start position Sa at center of crucible 12 to stop position Sb at peripheral portion of crucible 12. According to this traveling path pattern, filter 21 catches and removes the slag all over the surface of the molten metal A in crucible 12. FIG. 6B shows that filter 21 moves in radial direction from start position Sa at center of crucible 12 to circumference path C1 and travels along path C1, next moves in radial direction from path C1 to path C2 and travels along path C2, and next moves in radial direction from path C2 to path C3 and travels along path C3 to stop position Sb at outer portion of crucible 12. Also according to this traveling path pattern, filter 21 catches and removes slag all over the surface of molten metal A in crucible 12.

The device for traveling filter and removing slag can be operated at air atmosphere or at vacuum atmosphere. Also, the device can be operated manually or automatically by pre-inputting total quantity of metal to be liquidized and size of crucible, for example. In vacuum liquidizing and casting process, the process roughly comprises liquidizing metal, measuring temperature of the molten metal, settling down of the molten metal, removal of slag, measuring temperature of the molten metal, and casting the molten metal into a mold to produce cast products. The device can be operated alone or in combination with a temperature measuring equipment (thermo-couple thermometer, radiation thermometer) and switching each process in several seconds while keeping vacuum atmosphere.

Although certain preferred embodiments of the present invention have been shown and described in detail, it should be understood that various changes and modifications may be made therein without departing from the scope of the appended claims.

What is claimed is:

1. Method for removing slag comprising:

preparing a filter of heat-resistant porous ceramics, which passes a molten metal and catches slag;

liquidizing a metal material in vacuum atmosphere to form the molten metal on which slag is floating; and traveling said filter along a surface of said molten metal rotating in circumference direction on entire surface of said molten metal in a crucible and removing said slag in vacuum atmosphere.

2. The method according to claim 1, wherein said filter is disk-shaped or plate-shaped.

3. A device for removing slag comprising:

a filter of heat-resistant porous ceramics, which passes a molten metal and catches slag in vacuum atmosphere; and a driving device for traveling said filter along a surface of the molten metal on which slag is floating and removing said slag in vacuum atmosphere;

means for rotating said filter in circumference direction on entire surface of said molten metal in a crucible.

4. The device according to claim 3, wherein said filter is disk-shaped or plate-shaped.

5. The device according to claim 3, wherein said driving device comprises:

a rod disposed above central portion of a crucible, which accommodates the molten metal;

a cylinder coaxially disposed with said rod; and an arm, an end of said arm connected to said filter, and another end of said arm rotatably fixed to a lower end of said cylinder and slidably fixed to a lower end of said rod.

* * * * *